US007427091B2

(12) United States Patent
Streater, Jr. et al.

(10) Patent No.: US 7,427,091 B2
(45) Date of Patent: Sep. 23, 2008

(54) SPEAR HEAD OVERSHOT FOR USE IN A CABLE GUIDED FISHING ASSEMBLY

(75) Inventors: James R. Streater, Jr., Humble, TX (US); Gregg A. Bosley, Houston, TX (US); David P. Ross, Katy, TX (US); C. Steven Isaacks, Cypress, TX (US)

(73) Assignee: National-Oilwell, DHT, L.P., Houston, TX (US)

( * ) Notice: Subject to any disclaimer, the term of this patent is extended or adjusted under 35 U.S.C. 154(b) by 94 days.

(21) Appl. No.: 11/218,144

(22) Filed: Sep. 1, 2005

(65) Prior Publication Data

US 2007/0046051 A1 Mar. 1, 2007

(51) Int. Cl.
*E21B 31/18* (2006.01)

(52) U.S. Cl. ..... 294/86.27; 294/86.29; 294/86.33; 294/86.17

(58) Field of Classification Search ..... 294/86.17, 294/86.19, 86.21, 86.26, 86.27, 86.29, 86.3, 294/86.31, 86.32, 86.33
See application file for complete search history.

(56) References Cited

U.S. PATENT DOCUMENTS

| | | | | | |
|---|---|---|---|---|---|
| 1,587,790 | A * | 6/1926 | Morton | ..... | 294/86.27 |
| 1,602,134 | A * | 10/1926 | Triplett | ..... | 294/86.2 |
| 1,801,456 | A * | 4/1931 | Pryor | ..... | 294/86.21 |
| 2,266,873 | A | 12/1941 | Lang | ..... | 294/116 |
| 2,507,127 | A | 5/1950 | True | ..... | 294/88 |
| 2,508,285 | A * | 5/1950 | Otis et al. | ..... | 294/86.18 |
| 2,605,131 | A * | 7/1952 | Marshall et al. | ..... | 294/86.18 |
| 4,004,835 | A | 1/1977 | Taylor | ..... | 294/86.29 |
| 4,515,403 | A | 5/1985 | Cheek | ..... | 294/86.31 |
| 6,196,309 | B1 * | 3/2001 | Estilette, Sr. | ..... | 166/98 |
| 6,719,052 | B1 * | 4/2004 | Harmon et al. | ..... | 166/301 |

FOREIGN PATENT DOCUMENTS

| | | | | |
|---|---|---|---|---|
| WO | WO02/092960 | 11/2002 | ..... | 31/18 |

OTHER PUBLICATIONS

Joe DeGeare, David Haughton, Mark McGurk, The Guide to Oilwell Fishing Operation.

Gulf Publishing Company, Oilwell Fishing Operations: Tools and Techniques, Aug. 1990.

(Continued)

*Primary Examiner*—Dean J Kramer
(74) *Attorney, Agent, or Firm*—Howrey LLP

(57) ABSTRACT

Disclosed is an improved spear head overshot. The spear head overshot is particularly useful as part of a cable-guided fishing assembly. The spear head overshot essentially comprises one or more pivot lugs, the pivot lugs comprising jaw sections and release point sections, an actuator slide, a wave spring, a pivot mandrel, a screw attached to the pivot mandrel, and a compression spring threaded over the screw. In operation, a spear head is inserted into the spear head overshot until the spear head passes the jaw sections of the pivot lugs, at which time the spear head is locked into place. To release the spear head, the release point sections of the pivot lugs are manually forced inward. Simultaneously, the jaw sections of the pivot lugs are forced outward, thereby allowing the spear head to be removed from the spear head overshot. In a cable-guided fishing operation, this process can be repeated as often as necessary.

17 Claims, 3 Drawing Sheets

OTHER PUBLICATIONS

Gunn Wireline, Wireline Tools.
National Oilwell, Cable Guided & Side Door Fishing Methods, 2004.
PCT International Search Report and Written Opinion for PCT/US2006/031376, dated Apr. 26, 2007.

* cited by examiner

SPEAR HEAD OVERSHOT FOR USE IN A CABLE GUIDED FISHING ASSEMBLY

FIELD OF THE INVENTION

The present invention generally relates to equipment used for removing downhole tools that are stuck in an oil or gas well. In particular, the present invention relates to an improved spear head overshot for use as part of a cable-guided fishing assembly used to remove downhole tools that have become stuck in an oil or gas well.

BACKGROUND OF THE INVENTION

There are various methods of completion and production in relation to an oil or gas well. Typically, an oil or gas well is completed by cementing casing strings in place along substantially the entire depth of the well. Once the well is completed, production can commence. To facilitate the production of hydrocarbons or other fluids from the well, production tubing is typically installed within the cased wellbore. Production tubing is set in a portion of the well generally concentric with the casing. The production tubing allows communication of the producing zone of the well with the surface.

After the casing and production tubing are installed in the well, there is often the need for various procedures to be performed on the well, such as perforating the well, well logging operations, and the like, to bring the well into productive status. These procedures are performed with tools that are typically attached to what is known as a wireline. The wireline is essentially a metallic, braided cable with a plurality of electrical conductors contained therein, or is often just a metallic braided cable. The various tools that are to be used for a given operation are lowered into the well on the end of the wireline and then activated and/or monitored at the surface by an operator. When operations with the tools are complete, the wireline and attached tools are pulled to the surface and removed from the well so that production can commence or resume, or so that further operations can be conducted in the well.

Occasionally, downhole tools become stuck in the well during the retrieval process. Downhole tools can become stuck in a well for various reasons, such as encountering a restriction that has formed in the inner diameter of the wellbore. Additionally, downhole tools sometimes become bridged over, or the line on which the tools are run becomes key-seated in the walls of the well bore, thereby hindering or preventing removal of the tools from the well. Often, these downhole tools are very expensive pieces of electronic instrumentation and/or have radioactive sources contained therein, and, thus, they must be retrieved from the well. Moreover, these tools often present a hindrance to further operations in or production from the well and therefore they must be retrieved from the well. The procedure of retrieving a stuck tool is typically known as "fishing."

For situations in which the stuck tool is still attached to an intact wireline, either a cable-guided fishing method (also known as the "cut and strip" method) or a side-door overshot method is typically used to retrieve the tool. The cable-guided fishing method is typically used for deep, open-hole situations or when a radioactive instrument is stuck in the hole. For these situations, the cable-guided fishing method is a safe method that offers a high probability of success. In particular, the cable-guided fishing method allows retrieval of the stuck tool while the tool remains attached to the cable, thereby minimizing or removing the possibility that the tool will fall down the well during the fishing operation, and allowing for the well bore to be cleared with a minimum of downtime. Further, in some instances, through the use of the cable-guided fishing method, the expensive multi-conductor cable can be salvaged.

The cable-guided fishing method is performed with a special set of tools, hereinafter referred to as the "fishing assembly." The fishing assembly typically comprises a cable hanger with a T-bar, a spearhead rope socket, a rope socket, one or more sinker bars, a spearhead overshot, and a "C" plate. To use the fishing assembly, the individual components of the assembly are assembled together in a series of steps. Specifically, a typical procedure for assembling the individual components of the fishing assembly is as follows (refer to FIG. 1 for a depiction of the individual components of the fishing assembly in their relative positions during and after assembly):

(1) a light pulling force is exerted on the wireline to remove any slack;

(2) a cable hanger (A) is attached to the wireline at the well head;

(3) the wireline is lowered until the cable hanger (A) rests on the well head or rotary table;

(4) the wireline is cut a short distance above the cable hanger (A);

(5) a spear head rope socket (B) is then "made up" to the end of the lower half of the severed wireline above the cable hanger (A);

(6) a rope socket (C) ("the upper rope socket") is made up to the end of the upper severed half of the wireline;

(7) one or more sinker bars (D) are connected to the upper rope socket (C);

(8) a spear head overshot (E) is connected to the lowermost sinker bar (D);

(9) the spear head overshot (E) is then engaged with the spear head rope socket (B), and a "test strain" is exerted on the assembly by "pulling" on the wireline to ensure that the components are properly connected;

(10) with the spear head overshot (E) engaged with the spear head rope socket (B), the wireline is then "pulled" to exert a force sufficient to raise the cable hanger (A) so that it can be removed from the assembly;

(11) after removing the cable hanger (A) from the assembly, a "C" plate (F) is placed under a specially-shaped section of the spear head rope socket (B);

(12) with the specially-shaped section of the spear head rope socket (B) resting on the "C" plate (F), the entire assembly can be lowered such that the "C" plate (F) rests on the well head or rotary table.

After assembling the individual components of the fishing assembly in this (or a similar) manner, the assembly can be used to "fish" the stuck tool out of the well.

In operation, the fishing assembly fishes the stuck tool out of the well in a series of steps. Specifically, the following steps are typical of the operation of the fishing assembly (refer to FIG. 2 for a depiction of the individual components of the fishing assembly in their relative positions during operation):

(1) the spear head overshot (E) is disconnected from the spear head rope socket (B) and raised up to the derrick man;

(2) the derrick man will then thread the spear head overshot (E) and sinker bar (D) through the first stand of pipe (G) to be run into the well as part of the fishing operation;

(3) the driller will then pick up the first stand of pipe (G) and suspend it over the well head;

(4) the spear head overshot (E) should then be connected to the spear head rope socket (B), a light strain taken on the cable, and the "C" Plate (F in FIG. 1) removed;
(5) the first stand of pipe (G) is then run in the well bore and the slips (H) are set;
(6) the "C" Plate is then replaced, and the assembly is allowed to rest on the tool joint;
(7) the spear head overshot (E) is then disconnected and raised back up to the derrick man;
(8) the derrick man threads the spear head overshot (E) and sinker bar (D) through the next stand of pipe (I), which in turn is picked up by the driller and suspended over the well head through use of the rig's elevator (J);
(9) the spear head overshot (E) is connected to the spear head rope socket (B), the "C" Plate is removed, and the second stand of pipe (I) is stabbed into and made up to the first stand of pipe (G) and run into the well bore;
(10) the "C" Plate is replaced, the spear head overshot (E) is again disconnected and raised up to the derrick man, and the procedure is repeated until enough pipe has been run into the well to contact and free the stuck tool;
(11) after the fish has been contacted and pulled free, the cable hanger (A in FIG. 1) is again placed on the cable, the rope sockets (B, C) are removed from the cable, and the cable tied together with a square knot;
(12) the elevator (J) is then latched around the "T" bar on the cable hanger, and a strain sufficient to pull the cable out of the tool is taken;
(13) the cable hanger is then removed, and the free cable is spooled on to a service truck reel;
(14) the fishing string along with the fish may then be pulled from the hole in the conventional manner.

While the fishing assembly and method of use described in the preceding paragraphs has proven to be quite successful, difficulties have arisen with some of the prior art components of the fishing assembly. For example, prior art spear head overshots typically require a three-prong "wedge" release tool to disengage the spear head from the spear head overshot. This three-prong "wedge" release tool requires rig floor personnel to effectively wrap the release tool around the spear head overshot, thereby putting the rig floor personnel in extremely close proximity to the fishing assembly and associated tubing. As one of ordinary skill in the art will recognize, close proximity to the fishing assembly and tubing presents a significant safety concern. Accordingly, the following improved spear head overshot eliminates the need for this close proximity and provides a safer and more efficient means to disengage the spear head from the spear head overshot.

SUMMARY OF THE INVENTION

This invention relates to an improved spear head overshot. In a preferred embodiment of the present invention, the spear head overshot comprises a hollow outer tubular. An oversized guide may be attached to the outer tubular at the lower end of the spear head overshot. Moving upward from the lower end, the hollow outer tubular contains two pivot lugs. The pivot lugs run parallel to each other and are effectively comprised of three portions: the "jaws"; the pivot rods; and the release points. The jaws are located at the lowermost portion of the pivot lugs and extend inwardly towards the hollow center of the outer tubular. The pivot rods extend longitudinally along a rectangular cutout section of the outer diameter of the outer tubular and effectively connect the jaws to the release points. The release points are located at the uppermost portion of the pivot lugs and extend through a square-shaped cutout section of the outer diameter of the outer tubular. That portion of the release points that extends through the square-shaped cutout sections of the outer tubular exhibits a recessed circular geometry.

A movable pivot mandrel is located adjacent to and effectively between the two release points within the outer tubular. At the upper portion of the pivot mandrel, a movable screw is threadably connected. The screw ascends longitudinally upward towards the upper portion of the outer tubular and, in conjunction with the pivot mandrel, is capable of longitudinal movement. At its upper end, the screw is effectively encased by a compression spring. The compression spring is held in place by two flat washers. The first flat washer is located at the uppermost end of the screw, while the second flat washer is located adjacent to the upper surface of an inner radial wall, which effectively compartmentalizes the outer tubular and serves to separate the lower end of the screw from the upper end. While the screw is capable of longitudinal movement through a bore in the inner radial wall, the compression spring biases the screw, and thereby the pivot mandrel, towards the upper end of the outer tubular.

An actuator slide is located between the outer diameter of the pivot mandrel and the inner diameter of the outer tubular. The upper shoulder of the actuator slide is perpendicular to the longitudinal axis of the outer tubular member, while the lower end slopes towards the pivot mandrel. The upper shoulder of the actuator slide is in contact with a wave spring. The wave spring is positioned between the upper shoulder of the actuator slide and the lower surface of the inner radial wall. The compression of the wave spring biases the actuator slide towards the lower end of the outer tubular, and consequently toward the release points of the pivot lugs. The slope of the lower end of the actuator slide forces the release points radially outward through the square-shaped cutout section of the outer tubular.

In a typical fishing operation, a spear head is inserted into the lower end of the spear head overshot of the present invention. As the spear head enters the lower end of the spear head overshot, the jaws of the pivot lugs are forced outward (and the release points are inversely forced inward) until the arrowhead portion of the spear head passes beyond the jaws. As the spear head passes, the jaws essentially snap back into their initial position due to the contact of the actuator slide with the release points and the downward bias of the wave spring. At this point, the spear head is engaged within the spear head overshot.

At this point in the fishing operation, an upward force is exerted on the spear head overshot. This upward force, in combination with the static force being exerted on the spear head (from the stuck down hole tool), causes the lower shoulder of the arrowhead portion of the spear head to abut the upper shoulders of the jaws. As the upward force on the spearhead overshot increases, the spear head forces the jaws, and thereby the pivot lugs, longitudinally downward into contact with an upper shoulder of the outer tubular. This movement of the pivot lugs also forces the pivot mandrel longitudinally downward (overcoming the bias of the compression spring) due to the abutment of opposing shoulders of the pivot lugs and the pivot mandrel. The downward movement of the pivot lugs also forces two lips on the lower portion of the jaws to tuck in against the inner diameter of the outer tubular. These lips prohibit the disengagement of the spear head from the spear head overshot while the assembly is in tension.

When the upward pulling force is no longer acting on the spear head overshot, the movement of the internal components as described above is essentially reversed. To remove the spear head, a two-pronged release tool is manually placed in contact with the spear head overshot such that the two prongs engage the two release points of the pivot lugs. The two pronged release tool essentially squeezes the release points inward. As the release points of the pivot lugs are forced inward, the jaws of the pivot lugs are inversely forced outward. As such, the arrowhead portion of the spear head may pass by the jaws without contact. Accordingly, the spear point may be lowered and disengaged from within the spear head overshot. The two-pronged release tool (not shown) is then manually disengaged from the spear head overshot, which causes the wave spring to again force the actuator slide downward, which subsequently causes the actuator slide to again force the release points outward.

Additional objects and advantages of the invention will become apparent as the following detailed description of the preferred embodiment is read in conjunction with the drawings.

BRIEF DESCRIPTION OF THE DRAWINGS

The following figures form part of the present specification and are included to further demonstrate certain aspects of the present invention. The invention may be better understood by reference to one or more of these figures in combination with the detailed description of the specific embodiment presented herein.

FIG. 7 further illustrates the spear head overshot actuated such that the spear head may be removed from the overshot.

DESCRIPTION OF ILLUSTRATIVE EMBODIMENTS

The following example is included to demonstrate a preferred embodiment of the present invention. It should be appreciated by those of skill in the art that the apparatus and method disclosed in the example that follows represent techniques discovered by the inventors to function well in the practice of the invention, and thus can be considered to constitute a preferred mode for its practice. However, those of skill in the art should, in light of the present disclosure, appreciate that many changes can be made in the specific embodiment which is disclosed and still obtain a like or similar result without departing from the spirit and scope of the invention.

Figure 1:
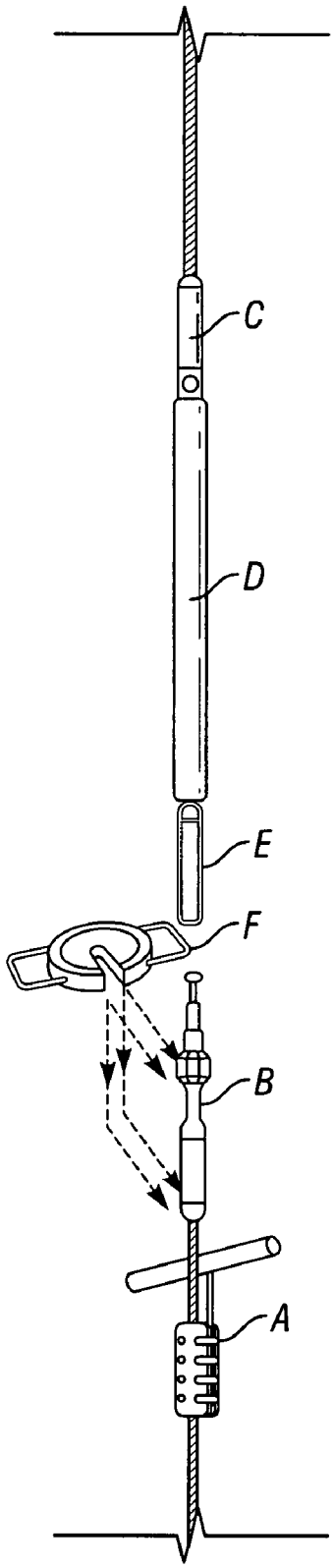
FIG. 1 (Prior Art)
FIG. 1 is a side view of a typical cable-guided fishing assembly showing the various components of such assembly in their respective positions.
Figure 2:
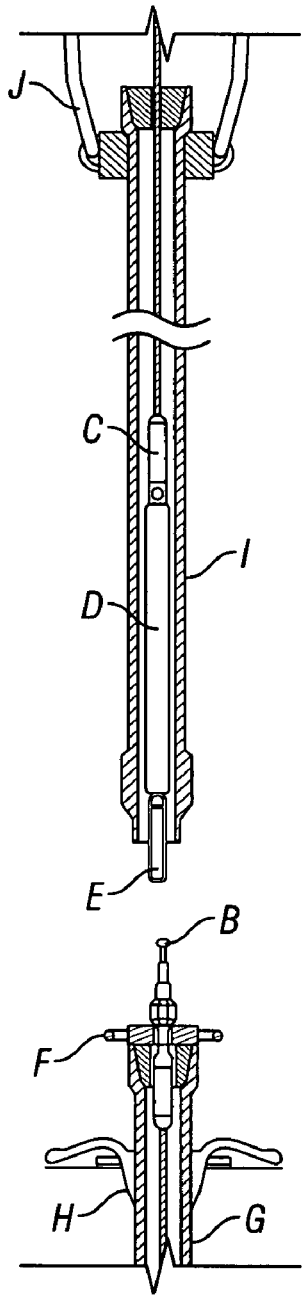
FIG. 2 (Prior Art)
FIG. 2 is a side view of a typical cable-guided fishing assembly showing the various components of such assembly in their respective positions within tubular members during operation.
Figure 5:
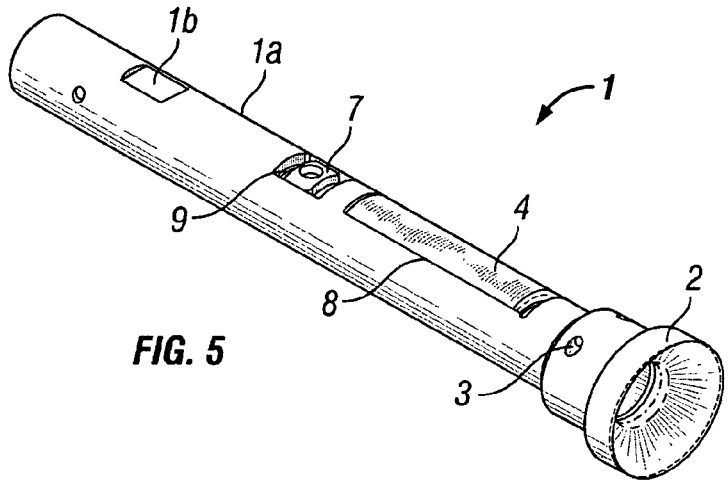
FIG. 5 is a three-dimensional view of the spear head overshot of the present invention.
Figure 4:
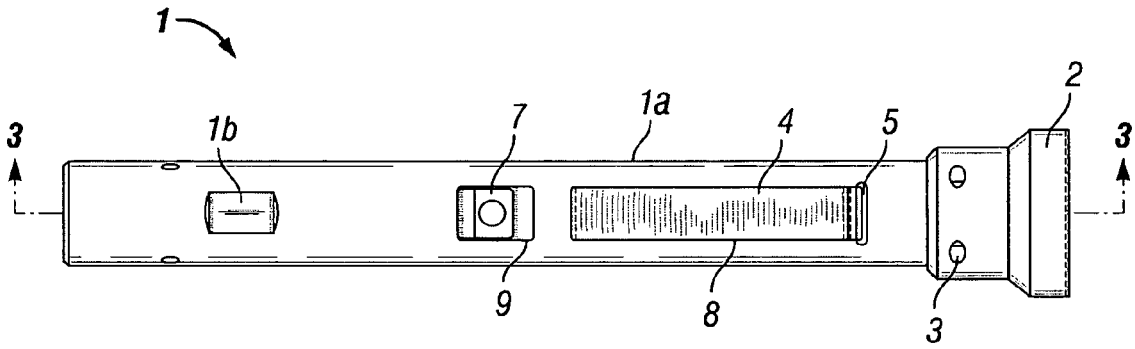
FIG. 4 is a side view of the spear head overshot of the present invention.
Figure 3:
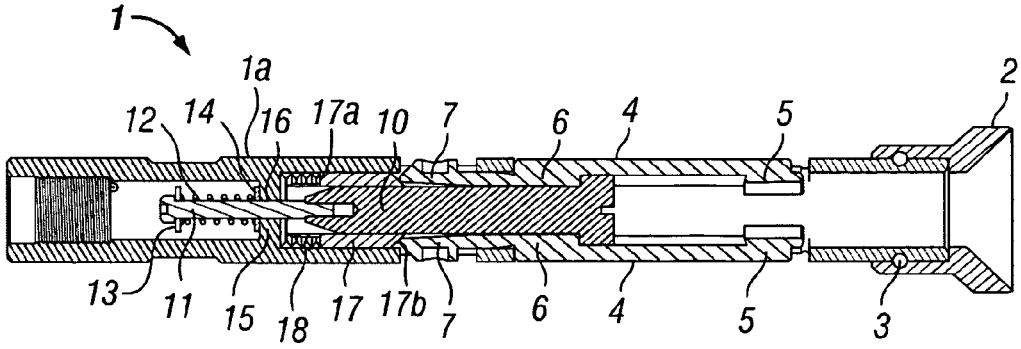
FIG. 3 is a cross-sectional view of the spear head overshot of the present invention viewed along the line 3-3 shown in FIG. 4.

FIGS. 3 through 5 illustrate a preferred embodiment of the spear head overshot of the present invention. While the spear head overshot is preferably comprised of steel, any material capable of withstanding the significant forces imposed on the spear head overshot during use may be used. Referring specifically to FIG. 3, the spear head over shot (1) comprises a hollow outer tubular (1*a*). The upper end of the outer tubular contains a set of female threads for connecting the spear head overshot to another component of the cable guide fishing assembly, typically a sinker bar. Attached to the outer tubular (1*a*) at the lower end is an oversized guide (2). The oversized guide (2) is preferably attached to the outer tubular (1*a*) using one or more spring pins (3), however any suitable attachment means may be used. As shown best in FIGS. 4 and 5, a wrench flat (1*b*) is located on the upper portion of the outer tubular (1*a*).

Referring again to FIG. 3, moving upward from the lower end, the hollow outer tubular (1*a*) contains two pivot lugs (4). The pivot lugs (4) run parallel to each other (approximately 180 degrees apart) and are effectively comprised of three portions: the "jaws" (5); the pivot rods (6); and the release points (7). The jaws (5) are located at the lowermost portion of the pivot lugs (4) and extend inwardly towards the hollow center of the outer tubular (1*a*). The pivot rods (6) extend longitudinally along a rectangular cutout section (8) (best shown in FIGS. 4 and 5) of the outer diameter of the outer tubular (1*a*) and effectively connect the jaws (5) to the release points (7). The release points (7) are located at the uppermost portion of the pivot lugs (4) and extend through a square-shaped cutout section (9) (best shown in FIGS. 4 and 5) of the outer diameter of the outer tubular (1*a*). As shown in FIGS. 4 and 5, the portion of the release points (7) that extends through the square-shaped cutout sections (9) of the outer tubular (1*a*) exhibit a recessed circular geometry. Although a circular geometry is preferred in this embodiment, any suitable geometry may be used.

Referring again to FIG. 3, a movable pivot mandrel (10) is located adjacent to and effectively between the two release points (7) within the outer tubular (1*a*). At the upper portion of the pivot mandrel (10), a movable screw (11) is threadably connected. Although a threadable connection is shown in the present embodiment, any suitable attachment means may be used. The screw (11) ascends longitudinally upward towards the upper portion of the outer tubular (1*a*) and, in conjunction with the pivot mandrel (10), is capable of longitudinal movement. At its upper end, the screw (11) is effectively encased by a compression spring (12). The compression spring is held in place by two flat washers (13, 14). The first flat washer (13) is located at the uppermost end of the screw (11), while the second flat washer (14) is located adjacent to the upper surface of an inner radial wall (15), which effectively compartmentalizes the outer tubular (1*a*) and serves to separate the lower end of the screw (11) from the upper end. While the screw (11) is capable of longitudinal movement through a bore (16) in the inner radial wall (15), the compression spring (12) biases the screw (11), and thereby the pivot mandrel (10), towards the upper end of the outer tubular (1*a*).

An actuator slide (17) is located between the outer diameter of the pivot mandrel (10) and the inner diameter of the outer tubular (1*a*). The upper shoulder (17*a*) of the actuator slide (17) is perpendicular to the longitudinal axis of the outer tubular member (1*a*), while the lower end (17*b*) slopes towards the pivot mandrel (10) at roughly a 45-degree angle. While a 45-degree angle is preferred in the present embodiment, any suitable angle may be used. The upper shoulder (17*a*) of the actuator slide (17) is in contact with a wave spring (18). The wave spring (18) is positioned between the upper shoulder (17*a*) of the actuator slide (17) and the lower surface of the inner radial wall (15). The compression of the wave spring (18) biases the actuator slide (17) towards the lower end of the outer tubular (1*a*), and consequently toward the release points (7) of the pivot lugs (4). The slope of the lower end (17*b*) of the actuator slide (17) forces the release points (7) radially outward through the square-shaped cutout section (9) of the outer tubular (1*a*).

Figure 6:
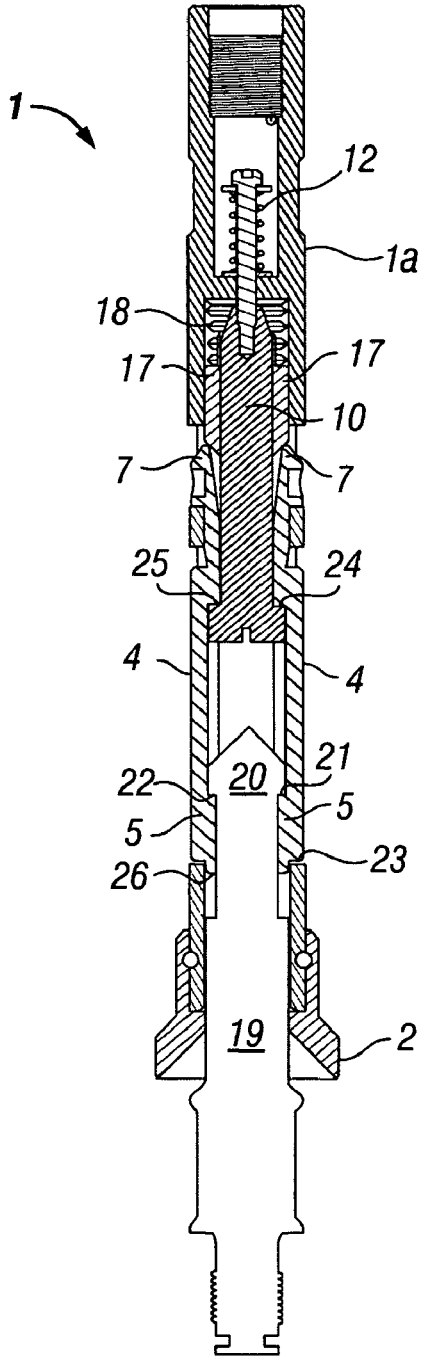
FIG. 6 is a cross-sectional view of a spear head engaged within the spear head overshot of the present invention.

Referring generally to the "fishing" operation described in the "BACKGROUND" section above, a spear head (19), as shown in FIG. 6, is inserted into the lower end of the spear head overshot (1) of the present invention. As the spear head (19) enters the lower end of the spear head overshot (1), the jaws (5) of the pivot lugs (4) are forced outward (and the release points (7) are inversely forced inward) until the arrowhead portion (20) of the spear head (19) passes beyond the jaws (5). As the spear head (19) passes, the jaws (5) essentially snap back into their initial position (as shown in FIG. 6) due to the contact of the actuator slide (17) with the release points (7) and the downward bias of the wave spring (18). At this point, the spear head (19) is engaged within the spear head overshot (1).

As further described in the fishing operation above, an upward force is then exerted on the spear head overshot (1). This upward force, in combination with the static force being exerted on the spear head (19) (from the stuck down hole tool), causes the lower shoulder (21) of the arrowhead portion (20) of the spear head (19) to abut the upper shoulders (22) of the jaws (5). As the upward force on the spearhead overshot (1) increases, the spear head (19) forces the jaws (5), and thereby the pivot lugs (4), longitudinally downward into contact with an upper shoulder (23) of the outer tubular (1*a*). This movement of the pivot lugs (4) also forces the pivot mandrel (10) longitudinally downward (overcoming the bias of the compression spring (12)) due to the abutment of opposing shoulders (24, 25) of the pivot lugs (4) and the pivot mandrel (10). The downward movement of the pivot lugs (4) also forces two lips (26) on the lower portion of the jaws (5) to essentially tuck in against the inner diameter of the outer tubular (1*a*). These lips (26) prohibit the disengagement of the spear head (19) from the spear head overshot (1) while the assembly is in tension.

Figure 7:
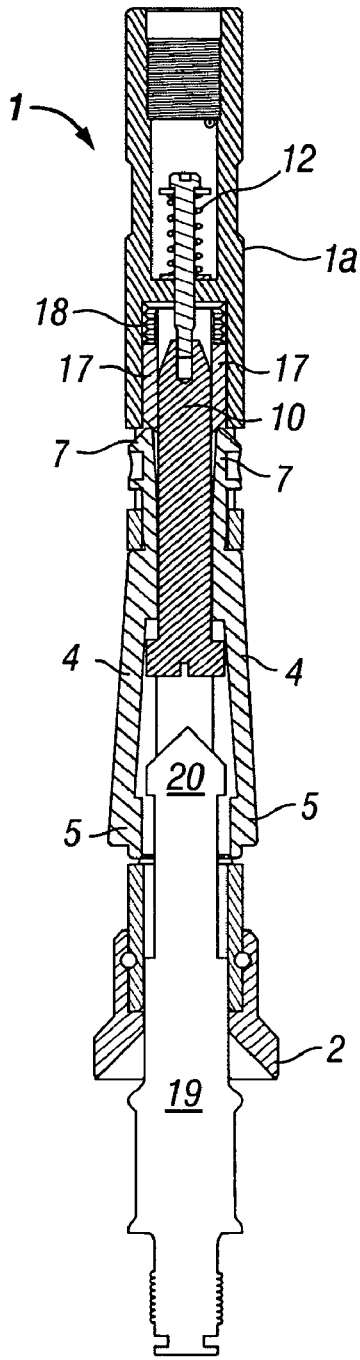
FIG. 7 is a cross-sectional view of a spear head engaged within the overshot of the present invention.

When the upward pulling force is no longer acting on the spear head overshot (1), the movement of the internal components as described above is essentially reversed. The spear head (19), and thereby the pivot lugs (4), move upwardly once again. At this point, the assembly is no longer in tension, and the spear head (19) can be removed from the spear head overshot (1). To remove the spear head (19), a two-pronged release tool (not shown) is preferably utilized. The two-pronged release tool is manually placed in contact with the spear head overshot (1) such that the two prongs engage the two release points (7) of the pivot lugs (4). As shown in FIG. 7, the two-pronged release tool (not shown) essentially squeezes the release points (7) inward. As the release points (7) of the pivot lugs (4) are forced inward, the jaws (5) of the pivot lugs (4) are inversely forced outward. As such, the arrowhead portion (20) of the spear head (19) may pass by the jaws (5) without contact. Accordingly, the spear point (19) may be lowered and disengaged from within the spear head overshot (1). The two-pronged release tool (not shown) is then manually disengaged from the spear head overshot (1), which causes the wave spring (18) to again force the actuator slide (17) downward, which subsequently causes the actuator slide (17) to again force the release points (7) outward.

The process of engaging and disengaging the spear head (19) from within the spear head overshot (1) may be repeated as many times as necessary according to the specific parameters of the fishing operation.

While the apparatus and method of this invention has been described in terms of a preferred embodiment, it will be apparent to those of skill in the art that variations may be applied to the apparatus and method described herein without departing from the concept and scope of the invention. All such similar substitutes and modifications apparent to those skilled in the art are deemed to be within the scope and concept of the invention as it is set out in the following claims.

The invention claimed is:

1. A spear head overshot comprising:

an outer tubular having an upper end and a lower end, the outer tubular capable of receiving a spear head at the lower end;

at least one pivot lug positioned at least partially within the outer tubular, the pivot lug comprising a release member and a jaw member, the jaw member capable of engaging the spear head;

an actuator slide positioned at least partially within the outer tubular, the actuator slide capable of engaging the release member;

a first spring adjacent to the actuator slide, the first spring capable of biasing the actuator slide into engagement with the release member;

a pivot mandrel adjacent to the pivot lug and actuator slide;

a screw attached to the pivot mandrel; and a second spring placed about the screw, the second spring capable of biasing the pivot mandrel toward the upper end of the outer tubular.

2. The spear head overshot of claim 1 further comprising two pivot lugs.

3. The spear head overshot of claim 2 wherein the two pivot lugs are parallel to one another.

4. The spear head overshot of claim 1 further comprising a guide attached to the lower end of the outer tubular.

5. The spear head overshot of claim 4 wherein the guide is attached to the lower end of the outer tubular using one or more spring pins.

6. The spear head overshot of claim 1 wherein the pivot mandrel abuts the at least one pivot lug.

7. The spear head overshot of claim 1 wherein the second spring is capable of biasing the at least one pivot lug toward the upper end of the outer tubular.

8. The spear head overshot of claim 1 wherein the at least one release member comprises a recessed, circular geometry.

9. The spear head overshot of claim 1 wherein the at least one jaw member comprises a lip.

10. The spear head overshot of claim 1 wherein the pivot mandrel is capable of longitudinal movement toward the lower end of the outer tubular.

11. The spear head overshot of claim 1 wherein the at least one pivot lug is capable of longitudinal movement toward the lower end of the outer tubular.

12. A method of constructing a spear head overshot comprising:

providing an outer tubular having an upper end and a lower end, the outer tubular capable of receiving a spear head at its lower end;

locating at least one pivot lug at least partially within the outer tubular, the pivot lug comprising a release member and a jaw member, the jaw member capable of engaging the spear head;

locating an actuator slide at least partially within the outer tubular, the actuator slide capable of engaging the release member;

locating a first spring adjacent to the actuator slide, the first spring capable of biasing the actuator slide into engagement with the release member;

locating a pivot mandrel adjacent to the pivot lug and actuator slide;

attaching a screw to the pivot mandrel; and placing a second spring around the screw, the second spring capable of biasing the pivot mandrel toward the upper end of the outer tubular.

13. The method of claim 12 wherein the step of locating at least one pivot lug at least partially within the outer tubular comprises locating two pivot lugs at least partially within the outer tubular.

14. The method of claim 13 wherein the step of locating two pivot lugs at least partially within the outer tubular further comprises locating the two pivot lugs parallel to one another.

15. The method of claim 12 further comprising attaching a guide to the lower end of the outer tubular.

16. A method of engaging a spear head within a spear head overshot, the method comprising:

providing a spear head overshot comprising an outer tubular having an upper end and a lower end; two pivot lugs positioned at least partially within the outer tubular and parallel to one another, the pivot lugs each comprising a release member and a jaw member; an actuator slide positioned at least partially within the outer tubular, the actuator slide capable of engaging the release members; a first spring adjacent to the actuator slide, the first spring capable of biasing the actuator slide into engagement with the release members; a pivot mandrel adjacent to the pivot lugs and actuator slide; a screw attached to the pivot mandrel; and a second spring around the screw, the second spring capable of biasing the pivot mandrel toward the upper end of the outer tubular; and inserting a spear head into the lower end of the spear head overshot.

17. A method of disengaging a spear head from within the lower end of a spear head overshot, the method comprising:

providing a spear head engaged within a spear head overshot, the spear head overshot comprising an outer tubular having an upper end and a lower end; two pivot lugs positioned at least partially within the outer tubular and parallel to one another, the pivot lugs each comprising a release member and a jaw member; an actuator slide positioned at least partially within the outer tubular, the actuator slide capable of engaging the release members; a first spring adjacent to the actuator slide, the first spring capable of biasing the actuator slide into engagement with the release members; a pivot mandrel adjacent to the pivot lugs and actuator slide; a screw attached to the pivot mandrel; and a second spring around the screw, the second spring capable of biasing the pivot mandrel toward the upper end of the outer tubular;

simultaneously compressing the release members of the spear head overshot; and removing the spear head from within the spear head overshot.

* * * * *